United States Patent [19]

Waiser

[11] Patent Number: 4,721,092

[45] Date of Patent: Jan. 26, 1988

[54] TRIGGER DEVICE FOR CROSS BOWS, WITH AUTOMATICALLY ACTIVATED SAFETY MEANS

[76] Inventor: Shimon Waiser, P.O. Box 360 Midwood Station, Brooklyn, N.Y. 11230

[21] Appl. No.: 861,606

[22] Filed: May 9, 1986

[51] Int. Cl.[4] ..... F41B 5/00; F41C 17/00

[52] U.S. Cl. ..... 124/40; 124/25

[58] Field of Search ..... 124/25, 35 A, 35 R, 124/40

[56] References Cited

U.S. PATENT DOCUMENTS

| | | | |
|---|---|---|---|
| 1,538,717 | 5/1925 | Mead | 124/40 |
| 1,560,733 | 11/1925 | Roe | 124/40 |
| 4,030,473 | 6/1977 | Puryear | 124/40 |
| 4,192,281 | 3/1980 | King | 124/40 |
| 4,479,480 | 10/1984 | Holt | 124/35 R |

FOREIGN PATENT DOCUMENTS

| | | | |
|---|---|---|---|
| 504997 | 5/1939 | United Kingdom | 124/25 |

*Primary Examiner*—Richard C. Pinkham
*Assistant Examiner*—Benjamin Layno

[57] ABSTRACT

A cross bow trigger device having an automatically activated safety includes a trigger, a catch and at least one intermediate safety member cooperating with the catch. The catch is pivotally mounted in the trigger device and has an upper part extending above the trigger device. When a projectile pusher, such as a cross bow string, is being cocked back, it engages and pivots the catch. This pivoting motion automatically engages the catch with the intermediate safety member moving it to a position locking the trigger and preventing the trigger from being unintentionally pulled. The trigger device is also provided with a knob accessible for a user and connected to the intermediate safety member to manually unlock or lock the trigger.

18 Claims, 9 Drawing Figures

TRIGGER DEVICE FOR CROSS BOWS, WITH AUTOMATICALLY ACTIVATED SAFETY MEANS

BACKGROUND OF THE INVENTION

This invention relates to trigger mechanisms, and in particular to trigger devices for cross bows having automatic safety means.

Trigger devices for cross bows are disclosed for example in U.S. Pat. No. 4,192,281 and in U.S. Pat. No. 4,030,473. They include safety mechanisms with automatic safety means which are activated by cross bow strings. Such devices can not be activated by projectile slide-pushers which are connected to cross bow strings, because the slide-pusher has much longer surface which contacts a barrel, than the cross bow string.

SUMMARY OF THE INVENTION

Accordingly, it is an object of the present invention to provide a cross bow trigger device with automatically activated safety means which avoids the disadvantages of the prior art.

Another object of the invention is to provide a cross bow with a trigger device having automatic safety mechanism activated by either projectile slide-pusher or a cross bow string.

It is a further object of this invention to provide a cross bow with a trigger device having a catch to hold either a cross bow string or projective slide-pusher and having an automatic safety mechanism activated by said catch.

It is also an object of the present invention to provide a cross bow automatic safety mechanism with a longitudinal moving part, which locks a cross bow trigger in safe position for maximum reliability.

In keeping with these objects and with others which will become apparent hereinafter, one feature of the present invention resides, briefly stated in a trigger device which is provided with an intermediate element arranged so that when a catch of the trigger device turns during cocking it moves the intermediate element into engagement with a trigger and prevents unintentional turning of the latter so as to prevent unintentional shooting.

The novel features of the invention are set forth in particular in the appended claims. The invention itself, however, will be best understood from the following description of preferred embodiments, which is accompanied by the following drawings.

DETAILED DESCRIPTION

Figure 2:
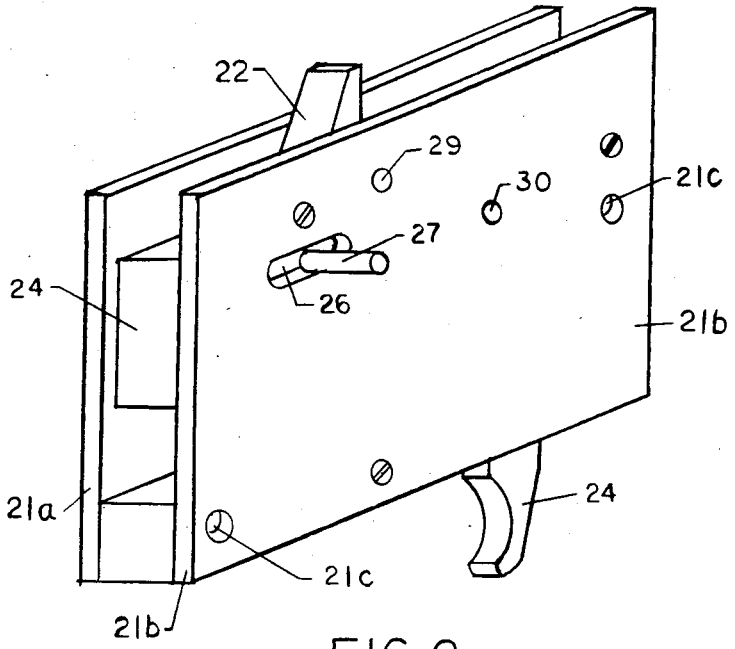
FIG. 2 is a perspective view of the trigger device of the first modification.
Figure 1:
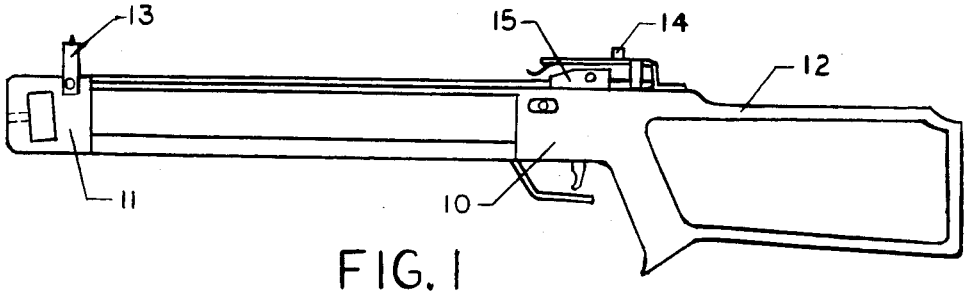
FIG. 1 is a side elevational view of the cross bow with a bow and a string removed.
Figure 5:
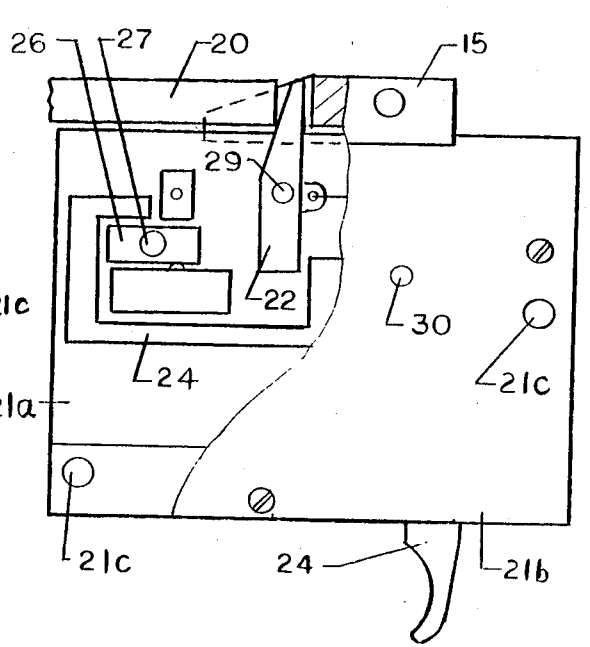
FIG. 5 is a side elevational view showing the relative position of the trigger device of the first modification, the projectile slide-pusher and an arrow when the trigger device is in the locked position and has one side plate partially broken, and when the projectile slide-pusher is also partially broken.
Figure 4:
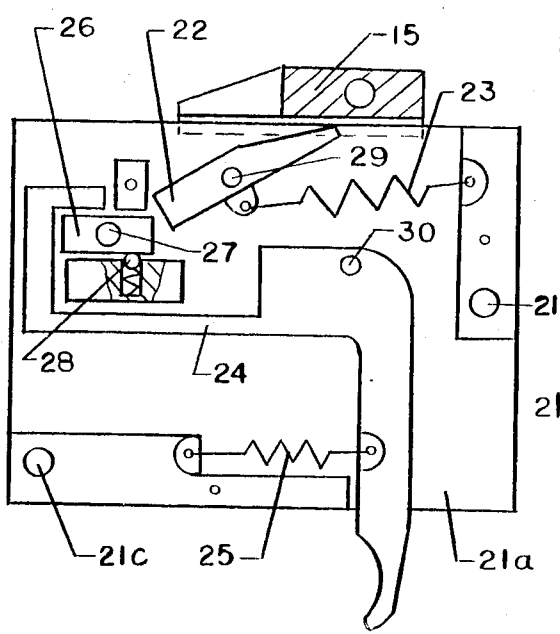
FIG. 4 is a side elevational view of the trigger device of the first modification similar to FIG. 3, partly in section, during the projectile slide-pusher movement backwards above the catch.
Figure 8:
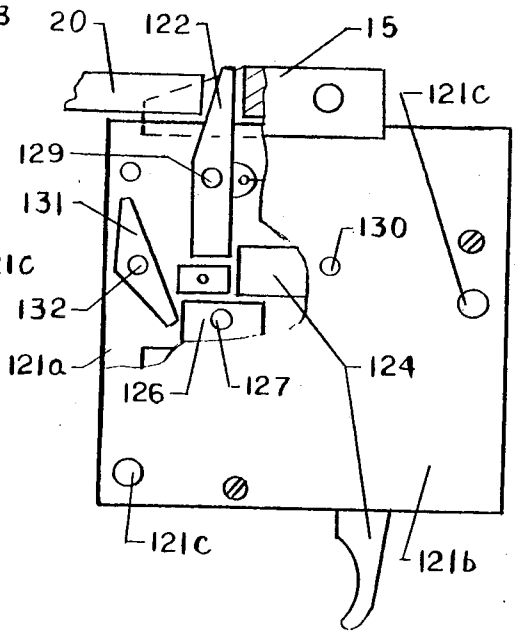
FIG. 8 is a side elevational view showing the relative position of the trigger device of the second modification, the projectile slide-pusher and an arrow when the trigger device is in the locked position and has one side plate partially broken, and when the projectile slide-pusher is also partially broken.
Figure 7:
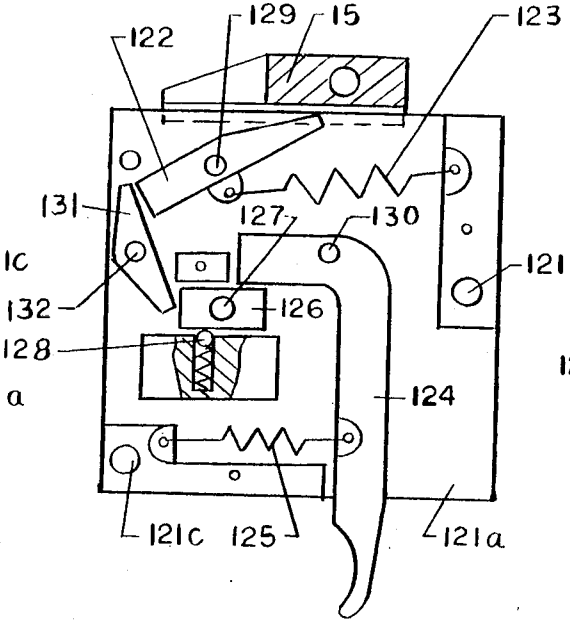
FIG. 7 is a side elevational view of the trigger device of the second modification similar to FIG. 6, partly in section, during the projectile slide-pusher movement backwards above the catch.
Figure 6:
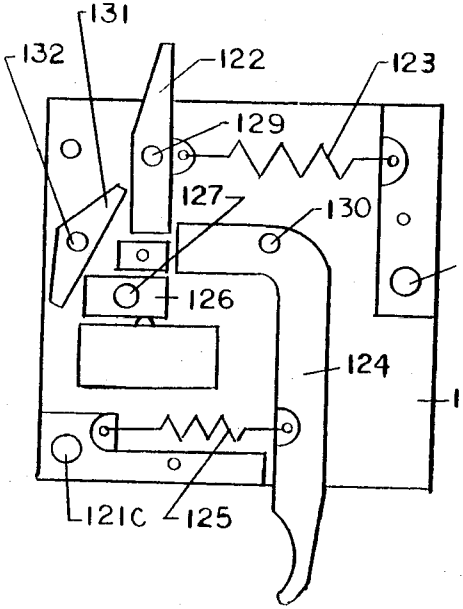
FIG. 6 is a side elevational view of the trigger device of the second modification in an unlocked position with one side plate removed.

Referring more in detail to the drawings, FIG. 1 shows a cross bow which can include either a trigger device of the first modification disclosed in FIGS. 2–5 or a trigger device of the second modification disclosed in FIGS. 6–8.

The cross bow comprises a stock 10 having a fore end portion 11 and a butt 12. The fore end portion 11 is provided with a front sight 13, a rear sight 14, and a bow prod (not shown) with a bow string (not shown) to which a projectile slide-pusher 15 can be connected. The rear part of the fore end portion 11 has a slot which extends from the upper surface to the lower surface of the fore end portion 11. A trigger device is located in the slot. An arrow 20 can be propelled from the cross bow of FIG. 1 by the bow string itself or by the slide-pusher 15. If the slide pusher 15 has in its forward part facing a recess (not shown) to accommodate a pellet (not shown), the cross bow can also shoot pellets.

Referring now to FIGS. 2–5 which show main features of the trigger device of the first modification.

The trigger device comprises two side plates **21*a* and 21*b* having two through holes 21*c* to be fastened in the cross bow stock 10 by two screws or bolts (not shown). A catch 22 is pivotally mounted by a pivot pin 29 and a trigger 24 is pivotally mounted by a pivot pin 30 between the side plates 21*a* and 21*b*. The catch 22 is under the action of a spring 23 and the trigger 24 is under the action of a spring 25 which return said catch 22 and trigger 24 to their initial positions after they have been turned. A safety stem 26 is located in the left part of the trigger device and has two working positions, namely, fire and safe positions. In the fire position (see FIG. 3) the stem 26 does not engage the trigger 24 and the latter can be pivoted counter-clockwise for a shot. In the safe position (see FIG. 5) the stem 26 engages the trigger 24 and the latter can not be pivoted and thereby a shot can not be made. A knob 27 projecting outside of the trigger device can move the stem 26 from the fire position to the safe position and vice versa if a shooter manually moves the knob 27 in corresponding directions. The stem 26 also can be moved from the fire position (see FIG. 3) to the safe position (see FIG. 5) by the bow string (not shown) or by the projectile slide-pusher 15 which turns the catch 22 clockwise (see FIG. 4) so that the catch 22 pushes the stem 26 longitudinal moving it to the left into an engagement with said trigger 24, locking the latter to prevent it from being turned by a user. A spring-loaded steel ball 28 is arranged to fix the stem 26** in the fire and safe positions.

Figure 3:
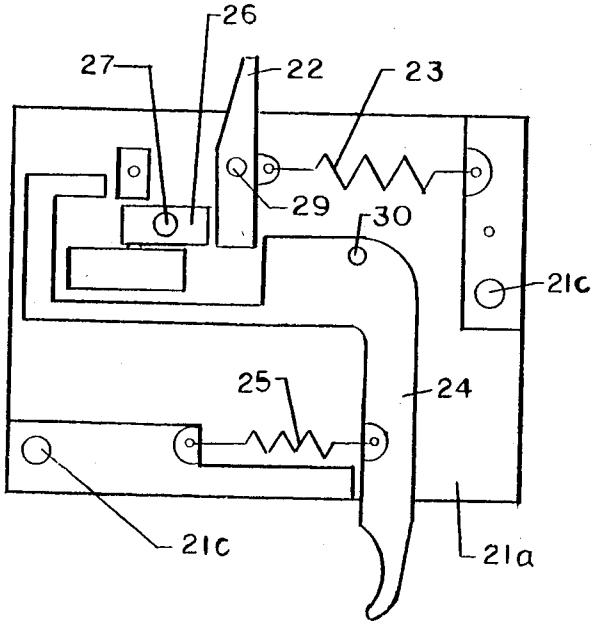
FIG. 3 is a side elevational view of the trigger device of the first modification in an unlocked position with one side plate removed.

Usually after a shot the stem 26 stays in the fire position (see FIG. 3). To cock the cross bow a user moves a projectile pusher, which can be the cross bow string or the slide-pusher 15, backwards and engages the pusher with the catch 22. During the movement backwards the projectile pusher turns the catch 22 clockwise (see FIG. 4) and the catch 22 pushes the stem 26 longitudinal moving it to the left so that the stem 26 engages the trigger 24. After this the trigger 24 is locked and can not be turned for a shot. To make a shot the user moves the stem 26 backwards to the fire position using for this purpose the knob 27. Now the user can make a shot if he pulls the trigger 24 backwards and counter-clockwise. But if the user reconsiders his decision to make a shot when the stem 26 is already in the fire position, he can move manually the stem 26 forward into the safe position using the knob 27.

Referring now to FIGS. 6–8 which shows main features of the trigger device of the second modification.

The trigger device comprises two side plates **121*a* and 121*b* having two through holes 121*c* to be fastened in the cross bow stock 10 by two screws or bolts (not shown). A catch 122 is pivotally mounted by a pivot pin 129, a trigger 124 is pivotally mounted by a pivot pin 130, and an intermediate member 131 is pivotally mounted by a pivot pin 132 between the side plates 121*a* and 121*b*. The catch 122 is under the action of a spring 123 and the trigger 124 is under the action of a spring 125 which return said catch 122 and trigger 124 to their initial positions after they have been turned. A safety member 126 is located to the right of the bottom part of the intermediate member 131. The safety member 126 has two working positions, namely, fire and safe positions. In the fire position (see FIG. 6) the member 126 does not engage the trigger 124 and the latter can be pivoted counter-clockwise for a shot. In the safe position (see FIG. 8) the member 126 engages the trigger 124 and the latter can not be pivoted and thereby a shot can not be made. A knob 127 projecting outside of the trigger device can move the member 126 from the fire position to the safe position and vice versa if a user manually moves the knob 127 in corresponding directions. The member 126 also can be moved from the fire position (see FIG. 6) to the safe position (see FIG. 8) under the action of the bow string (not shown) or the projectile slide-pusher 15 which turns the catch 122 clockwise (see FIG. 7) and the catch 122, in turn, pushes and pivots the intermediate member 131 counter-clockwise. During its turning the intermediate member 131 pushes by its bottom part the member 126 to the right into an engagement with the trigger 124, locking the latter to prevent it from being turned by a user. A spring loaded steel ball 128 is arranged to fix the member 126** in the fire and safe positions.

Usually after a shot the member 126 stays in the fire position (see FIG. 6). To cock the cross bow a user moves a projectile pusher, which can be the cross bow string or the slide-pusher 15, backwards and engages the pusher with the catch 122. During the movement backwards the projectile pusher turns the catch 122 clockwise (see FIG. 7) and the catch 122 pushes the upper part of the intermediate member 131 and thereby pivots the member 131 counter-clockwise. The member 131, in turn, pushes by its bottom part the member 126 to the right and the member 126 engages the trigger 124. After this the trigger 124 is locked and can not be turned for a shot. To make a shot the user moves the member 126 forward to the fire position using for this purpose the knob 127. Now the user can make a shot if he pulls the trigger 124 backwards and counter-clockwise. But if the user reconsiders his decision to make a shot, when the member 126 is already in the fire position, he can move manually the member 126 backwards into the safe position using the knob 127.

Figure 9:
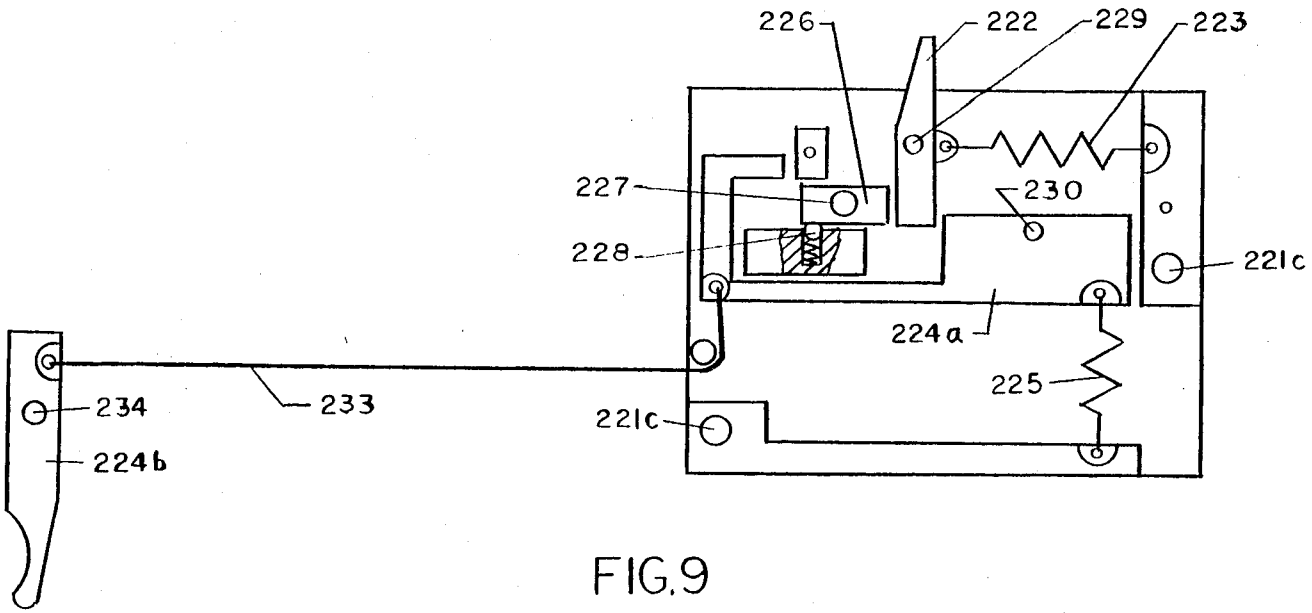
FIG. 9 is a side elevational view showing the relative position of the parts of the trigger device of the third modification having the trigger consisting of three parts one of which is flexible.

Referring now to FIG. 9 which shows main features of the cross bow trigger device of the third modification.

The trigger device comprises two separate units connected with one another by a flexible element.

The first of two separated units comprises two side plates having two through holes **221*c* to be fastened in the cross bow stock by two screws or bolts (not shown). A catch 222 is pivotally mounted by a pivot pin 229 and an intermediate trigger part 224*a* is pivotally mounted by a pivot pin 230 between the side plates. The catch 222 is under the action of a spring 223 and the intermediate trigger part 224*a* is under the action of a spring 225 which return the catch 222 and the intermediate trigger part 224*a* to their initial positions after they have been turned. A safety stem 226 is located at the left of the bottom part of the catch 222 and has two working positions, namely, fire and safe positions. In the fire position (see FIG. 9) the stem 226 does not engage the intermediate trigger part 224*a* and the latter can be pivoted counter-clockwise for a shot. In the safe position the stem 226 engages the intermediate trigger part 224*a* and the latter can not be pivoted and thereby a shot can not be made. A knob 226 projecting outwardly can move the stem 226 from the fire position to the safe position and vice versa if a shooter manually moves the knob 227 in corresponding directions. The stem 226 also can be moved from the fire position (see FIG. 9) to the safe position by the bow string or by the projectile slide-pusher which turns the catch 222 clockwise so that the catch 222 pushes the stem 226 to the left into an engagement with the intermediate trigger part 224*a*, locking the latter to prevent it from being turned by a user. A spring loaded steel ball 228 is arranged to fix the stem 226** in fire and safe positions.

The second of two separated units comprises a trigger part 224b, which is pivotally mounted in the cross bow stock by a pivot pin 234 and which is connected with the intermediate trigger part **224*a* by a steel rope 233**.

Usually after a shot the stem 226 stays in the fire position (see FIG. 9). To cock the cross bow a user moves a projectile pusher, which can be the cross bow string or the slide-pusher, backwards and engages the pusher with the catch 222. During the movement backwards the projectile pusher turns the catch 222 clockwise and the catch 222 pushes the stem 226 to the left so that the stem 226 engages the intermediate trigger part **224*a*. After this the intermediate trigger part 224*a* is locked and can not be turned for a shot. To make a shot the user moves the stem 226 backwards to the fire position using for this purpose the knob 227. Now the user can make a shot if he pulls and pivots the trigger part 224*b* which, in turn, pulls the steel rope 233 forward. The steel rope 233, in turn, pivots counter-clockwise the intermediate trigger part 224*a* disengaging it from the catch 222. But if the user reconsiders his decision to make shot, when the stem 226 is already in the fire position, he can move manually the stem 226 forward into the safe position using the knob 227**.

Although but a few modifications of the present invention have been illustrated and described, it will be apparent to those skilled in the art that various changes and modifications may be made therein without departing from the spirit of the invention or from the scope of the appended claims.

What is claimed is:

1. In a projectile shooting device, a projectile pusher; trigger means including a trigger and a turnable catch for holding said projectile pusher in a cocked position and for releasing said projectile pusher therefrom; said catch being positioned so as to be turned during cocking of said projectile pusher; and safety means for preventing unintentional shooting, said safety means including a movable intermediate element movable between fire and safe positions and cooperating with said catch so that when said catch turns during cocking said intermediate element is moved under the action of said catch to the safe position into an engagement with said trigger to lock said trigger and to prevent unintentional turning of the latter and to thereby prevent unintentional shooting, said movable intermediate element arranged so that it performs longitudinal motion under the action of said catch.

2. In a projectile shooting device, a projectile pusher; trigger means including a trigger and a turnable catch for holding said projectile pusher in a cocked position and for releasing said projectile pusher therefrom; said catch being positioned so as to be turned during cocking of said projectile pusher; and safety means for preventing unintentional shooting, said safety means including a movable intermediate element movable between fire and safe positions and cooperating with said catch so that when said catch turns during cocking said intermediate element is moved under the action of said catch to the safe position into an engagement with said trigger to lock said trigger and to prevent unintentional turning of the latter and to thereby prevent unintentional shooting, said movable intermediate element including at least two movable intermediate members, a first movable intermediate member and a second movable intermediate member, said first movable intermediate member cooperating with said catch so that when said catch turns during cocking said first movable intermediate member moves under the action of said catch and presses said second movable intermediate member to the safe position into an engagement with said trigger to lock said trigger and to prevent unintentional turning of the latter.

3. In a projectile shooting device, a projectile pusher; a stock having a longitudinally extended guide surface to guide said projectile pusher during its movement; trigger means including a trigger and a turnable catch for holding said projectile pusher in a cocked position and for releasing said projectile pusher therefrom; said catch being positioned so as to be turned during cocking of said projectile pusher; and safety means for preventing unintentional shooting, said safety means including a movable intermediate element movable between fire and safe positions and cooperating with said catch so that when said catch turns during cocking said intermediate element is moved under the action of said catch to the safe position into an engagement with said trigger to lock said trigger and to prevent unintentional turning of the latter and to thereby prevent unintentional shooting, said guide surface located above said movable intermediate element so that said movable intermediate element is situated entirely under said longitudinally extended guide surface of the stock.

4. In a projectile shooting device, a projectile pusher; trigger means including a trigger and a turnable catch for holding said projectile pusher in a cocked position and for releasing said projectile pusher therefrom; said catch being positioned so as to be turned during cocking of said projectile pusher; and safety means for preventing unintentional shooting, said safety means including a movable intermediate element movable between fire and safe positions and cooperating with said catch so that when said catch turns during cocking said intermediate element is moved under the action of said catch to the safe position into an engagement with said trigger to lock said trigger and to prevent unintentional turning of the latter and to thereby prevent unintentional shooting, said movable intermediate element at least partially situated in front of said catch.

5. In a projectile shooting device, a projectile pusher; trigger means including a trigger and a pivotally mounted catch for holding said projectile pusher in a cocked position and for releasing said projectile pusher therefrom, said catch having a lower part located below a pivot pin on which said catch is mounted; said catch being positioned so as to be turned during cocking of said projectile pusher; safety means for preventing unintentional shooting, said safety means including a movable intermediate element movable between fire and safe positions and cooperating with said catch lower part so that when said catch turns during cocking said intermediate element is moved under the action of said lower part of said catch to the safe position into an engagement with said trigger to lock said trigger and to prevent unintentional turning of the latter and to thereby prevent unintentional shooting.

6. The invention as defined in claims 1, 3, 4 or 5 wherein said movable intermediate element is spring-biased to fix the same in said fire and safe positions; and further comprising means for spring-biasing said movable intermediate element.

7. The invention as defined in claims 1, 3, 4 or 5; and further comprising manual switching means accessible to a user to switch manually said movable intermediate element from said fire to said safe position and vice-versa.

8. The invention as defined in claim 7 wherein said manual switching means includes a knob connected to said movable intermediate element and projecting outwardly.

9. The invention as defined in claims 1, 3, 4 or 5 wherein said projectile pusher is a cross bow string.

10. The invention as defined in claims 1, 3, 4 or 5 wherein said projectile pusher includes a slide-pusher and a cross bow string connected with said slide-pusher.

11. The invention as defined in claims 1, 3, 4 or 5 wherein said trigger consists of at least two separate parts, one of said two parts being accessible to a user and another of said two parts holding the catch when the cross bow is cocked, said other part of said trigger being under the influence of said one part of said trigger and being arranged to be engaged by said movable intermediate element when the latter is in the safe position.

12. The invention as defined in claim 11; and further comprising a flexible element connecting said two parts of said trigger with one another.

13. The invention as defined in claim 2 wherein said first movable intermediate member is arranged so that it turns under the action of said catch.

14. The invention as defined in claim 2 wherein said second movable intermediate member is arranged so that it performs longitudinal motion under the action of said first movable intermediate member.

15. The invention as defined in claim 2 wherein said second movable intermediate member is spring-biased to fix said second movable intermediate member in the fire and safe positions; and further comprising means for springbiasing said second movable intermediate member.

16. The invention as defined in claim 2; and further comprising manual switching means accessible to a user to switch manually said second movable intermediate member from said fire to said safe position and vice-versa.

17. The invention as defined in claim 13 wherein said manual switching means includes a knob connected to said second movable intermediate member and projecting outwardly.

18. The invention as defined in claims 3, 4 or 5 wherein said movable intermediate element includes at least two movable intermediate members, a first movable intermediate member and a second movable intermediate member, said first movable intermediate member cooperating with said catch so that when said catch turns during cocking said first movable intermediate member moves under the action of said catch and presses said second movable intermediate member to the safe position into an engagement with said trigger to lock said trigger and to prevent unintentional turning of the latter.

* * * * *

UNITED STATES PATENT AND TRADEMARK OFFICE

CERTIFICATE OF CORRECTION

PATENT NO. : 4,721,092

DATED : January 26, 1988

INVENTOR(S) : Shimon Waiser

It is certified that error appears in the above-identified patent and that said Letters Patent is hereby corrected as shown below:

Column 2, line 37, after "forward" insert --facing--.

Column 2, line 38, delete "facing"

Column 4, line 32, "226" should read --227--.

Column 8, line 3, "13" should read --16--.

Signed and Sealed this

Twenty-sixth Day of July, 1988

*Attest:*

DONALD J. QUIGG

*Attesting Officer*

*Commissioner of Patents and Trademarks*